United States Patent [19]

Gorbaty

[11] 3,975,168

[45] Aug. 17, 1976

[54] PROCESS FOR GASIFYING CARBONACEOUS SOLIDS AND REMOVING TOXIC CONSTITUENTS FROM AQUEOUS EFFLUENTS

[75] Inventor: Martin L. Gorbaty, Fanwood, N.J.

[73] Assignee: Exxon Research and Engineering Company, Linden, N.J.

[22] Filed: Apr. 2, 1975

[21] Appl. No.: 564,385

[52] U.S. Cl. ..... 48/197 R; 48/202; 55/85; 55/94

[51] Int. Cl.[2] ..... C10K 1/06; C10J 3/54

[58] Field of Search ..... 423/244, 242; 55/85, 55/93, 94, 228; 48/197 R, 202, 210, 206, 128; 110/1 J, 28 J; 122/4 D

[56] References Cited

UNITED STATES PATENTS

| | | | |
|---|---|---|---|
| 3,687,630 | 8/1972 | Tailor | 423/242 |
| 3,859,416 | 1/1975 | Urban | 423/242 |
| 3,876,750 | 4/1975 | Hauser | 423/242 |
| 3,932,146 | 1/1976 | Wilson et al. | 48/202 |

*Primary Examiner*—Robert L. Lindsay, Jr.
*Assistant Examiner*—George C. Yeung
*Attorney, Agent, or Firm*—James E. Reed

[57] ABSTRACT

Toxic trace element pollutants present in the raw product gas and raw flue gas streams produced during the gasification of coal or similar carbonaceous solids containing sulfur and such trace elements are recovered by separately scrubbing the product gas and flue gas with water, combining the resulting aqueous effluents, and removing the pollutants from the combined aqueous stream as insoluble metal sulfides.

10 Claims, 1 Drawing Figure

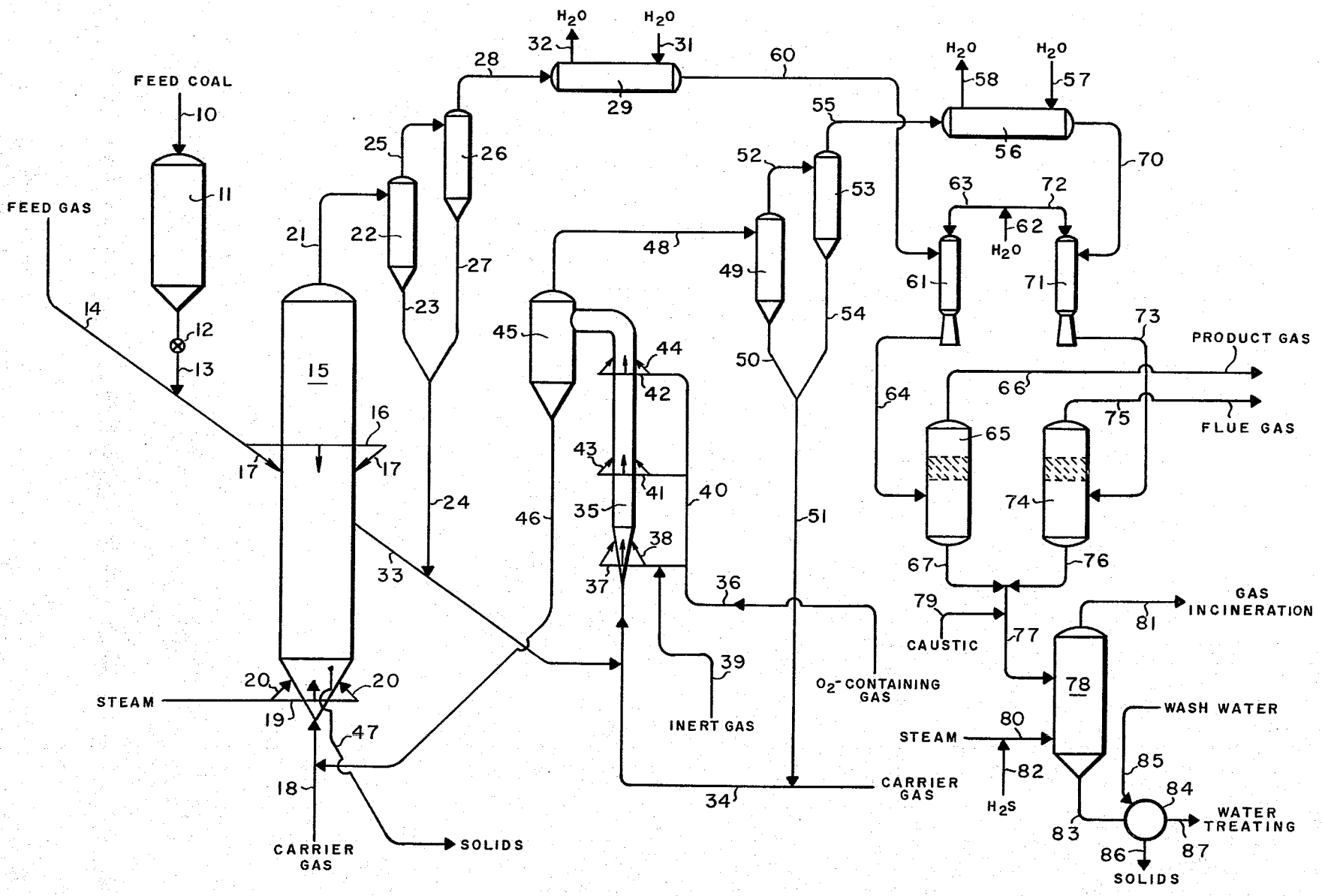
PRODUCT GAS
FLUE GAS
GAS INCINERATION
WASH WATER
WATER TREATING
SOLIDS
CAUSTIC
STEAM
CARRIER GAS
$O_2$-CONTAINING GAS
INERT GAS
$H_2S$
$H_2O$
FEED COAL
FEED GAS
CARRIER GAS
STEAM
SOLIDS

PROCESS FOR GASIFYING CARBONACEOUS SOLIDS AND REMOVING TOXIC CONSTITUENTS FROM AQUEOUS EFFLUENTS

BACKGROUND OF THE INVENTION

1. Field of the Invention

This invention relates to the gasification of coal and other carbonaceous solids and related processes and is particularly concerned with a method for the removal of toxic trace element pollutants from aqueous effluents produced during coal gasification and similar operations.

2. Description of the Prior Art

One of the problems associated with the gasification of coal and similar carbonaceous solids is that of preventing the discharge of toxic trace elements into the environment. Studies have shown that most coals contain small amounts of cadmium, cobalt, lead, zinc, mercury, antimony, arsenic, and other elements which are toxic in low concentrations and could become hazardous pollutants. Some of these elements are retained for the most part as insoluble compounds in the ash formed during gasification and combustion operations but others, such as mercury, are volatile enough to be present in trace quantities in the product and flue gas streams produced during such operations. These streams are normally cooled for the recovery of heat and the removal of condensed steam and then scrubbed with aqueous solvents and water washed to remove carbon dioxide, hydrogen sulfide, hydrogen cyanide and similar acidic constituents. As a result of these gas cleanup operations, the volatile trace element constituents may be transferred into process water streams where they may tend to accumulate. Because of the low concentrations in which these materials are normally present in the gases and the limited use of coal gasification and related processes in recent years, there has been relatively little attention directed to the elimination of these materials from the aqueous effluents. It can be shown, however, that large gasification plants and similar installations may produce such materials in quantities sufficient to create serious problems if they are not removed from the effluents.

SUMMARY OF THE INVENTION

This invention provides an improved process for the elimination of potentially toxic inorganic constituents from gaseous and aqueous effluents formed during coal gasification and related operations in which carbonaceous feed materials are reacted at high temperature to form a product gas stream containing hydrogen sulfide and coal, coal char or other materials containing trace elements are burned in a combustion zone to generate process heat. In accordance with the invention, it has now been found that such pollutants can be readily removed by scrubbing the product gas and the flue gas produced in the combustion zone with water to remove water-soluble constituents, combining the two aqueous effluent streams, stripping gaseous contaminants from the combined stream, and thereafter removing solids from the aqueous stripper effluent. This process results in the precipitation and recovery of toxic trace element contaminants from the gases as insoluble sulfides which can readily be disposed of without appreciable danger to the environment and at the same time avoids many of the difficulties posed by processes which have been employed or proposed for use in the past.

The process of the invention is based in part upon the fact that toxic trace element constituents can be removed from gas streams by scrubbing such streams with water, the fact that water which has been used for the scrubbing of product gas generated by the gasification of coal or similar carbonaceous solids containing sulfur normally has a high hydrogen sulfide content and the fact that water that has been used for the scrubbing of flue gas produced by the combustion of coal, coal char, coke or the like generally contains hydrogen sulfide in relatively low concentrations and includes toxic trace element constituents in significant quantities. By combining these two aqueous streams, toxic trace elements present in the aqueous effluents can be precipitated as sulfides which are highly stable and essentially insoluble in aqueous systems under normal pH conditions. The precipitated sulfides, which are similar to compounds existing in nature, can then be removed from solution by filtration, centrifugation, or the like and disposed of by landfill or other procedures with minimal danger of polluting the environment. The invention thus provides a simple, effective and low cost process which eliminates toxic trace element pollutants from aqueous and gaseous effluents produced during coal gasification and similar operations and permits the discharge of aqueous effluents essentially free of such pollutants.

BRIEF DESCRIPTION OF THE DRAWING

The drawing is a schematic flow diagram of a preferred process for the gasification of coal or similar carbonaceous solids carried out in accordance with the invention.

DESCRIPTION OF THE PREFERRED EMBODIMENTS

The process depicted in the drawing is one for the gasification of bituminous coal, subbituminous coal, lignite or similar carbonaceous solids with steam at high temperature to produce a product gas stream of relatively high methane content. It will be understood that the invention is not restricted to the particular process shown and can be used in conjunction with other processes which result in the production of a first gas stream containing hydrogen sulfide and a second gas stream which includes toxic trace element pollutants and contains hydrogen sulfide in a concentration below that of the first gas stream. Such processes may include, for example, operations for the carbonization of coal and similar feed solids, for the gasification of petroleum coke and other carbonaceous materials, for the retorting of oil shale and the like, for the generation of hydrogen from coal and other carbonaceous materials, for the partial combustion of hydrocarbons, and the like.

In the process shown, a solid carbonaceous feed material such as bituminous coal, subbituminous coal, lignite, coke or the like which has been crushed to a particle size of about 8 mesh or smaller on the Tyler Screen Scale is fed into the system through line 10 from a feed preparation plant or storage facility which does not appear in the drawing. If desired, this coal or other carbonaceous feed material may be impregnated or mixed with an alkali metal constituent to catalyze the gasification reaction. The feed solids introduced through line 10 are fed into a closed hopper or similar vessel 11 from which they are discharged through star wheel feeder or equivalent device 12 in line 13 at an elevated pressure sufficient to permit their introduction into the gasifier at the system operating pressure or a somewhat higher pressure. In lieu of or in addition to this particular type of arrangement, parallel lock hoppers, pressurized hoppers, aerated standpipes operated in series or other apparatus may be employed to raise the input feed solids stream to the required pressure level. The use of such equipment for handling coal and other finely divided solids at elevated pressure has been described in the literature and will therefore be familiar to those skilled in the art. Equipment which may be employed for this purpose is generally available from commercial sources.

A carrier gas stream is introduced into the system shown in the drawing through line 14 to permit the entrainment of coal particles or other solid feed materials from line 13 and facilitate introduction of the solids into gasifier 15. The carrier gas employed may be high pressure steam, recycle product gas, inert gas, or the like. The use of recycle product gas avoids reduction of the hydrogen concentration in the gasifier and is therefore generally preferred. The carrier gas stream is introduced into the system at a pressure at about 50 to about 2000 psig, depending upon the pressure at which gasifier 15 is operated and the solids feed material employed, and is preferably fed into the system at a pressure between about 100 and about 1000 psig. The gas may be preheated to a temperature in excess of about 300° F. but below the initial softening point of the coal or other carbonaceous feed material if desired. For the gasification of bituminous coals, for example, the use of carrier gas at temperatures within the range between about 400° and about 550° F. is often advantageous. Coal or other feed particles, preferably less than about 8 mesh in size on the Tyler Screen Scale, are suspended in the carrier gas stream in a ratio between about 0.2 and about 5.0 pounds of solid feed material per pound of carrier gas. The optimum ratio for a particular system will depend in part upon the feed particle size and density, the molecular weight of the gas employed, the temperature of the solid feed material and input gas stream, and other factors. In general, ratios between about 0.5 and about 4.0 pounds of coal or other solid feed material per pound of carrier gas are preferred.

The feed stream prepared by the entrainment of coal or other solid particles from line 13 in the gas introduced through line 14 is normally fed into the gasifier through one or more fluid-cooled nozzles not shown in the drawing. Cooling fluid will normally be low pressure steam but may also be water or the like. This fluid may be circulated in the nozzles for cooling purposes or injected into the gasifier around the stream of feed gas and entrained solids to control entry of the solids into a fluidized bed in the gasifier. In the system shown, the gas and entrained solids flow into injection manifold 16 and then pass into the gasifier through four injection nozzles 17 spaced about the gasifier periphery. The number of injection lines and nozzles employed will depend in part upon the gasifier diameter and the feed rates used and may be varied as necessary. Similarly, the level at which the coal or other solid feed material is introduced through the nozzles into the gasifier will depend in part upon the characteristics of the particular feed material selected and other factors. In the system shown, the solids are introduced at an intermediate level but in other cases they may be injected at or near the top or bottom of the gasifier.

The gasifier employed in the system depicted in the drawing comprises a refractory lined vessel containing a fluidized bed of char particles introduced into the lower end of the system through bottom inlet line 18. The inlet line extends upwardly through the bottom of the gasifier to a point above an internal grid or similar distribution device not shown in the drawing. Steam for maintaining the char particles in a fluidized state and reacting with the char to produce a synthesis gas containing hydrogen and carbon monoxide is introduced into the lower portion of the gasifier below the grid or other distribution device through manifold 19 and steam injection lines 20. The installation shown employs four steam injection lines spaced at 90° intervals about the gasifier periphery but a greater or lesser number may be employed if desired. Steam thus introduced will normally be fed into the system at a rate between about 0.5 and about 2.0 pounds of steam per pound of coal or other solids feed. The upflowing steam and suspended char particles form a fluidized bed which extends upwardly in the gasifier to a level above that at which the coal or other solid feed particles are introduced with the gas from line 14. The upper surface of this fluidized bed will normally be located a substantial distance above the feed injection level but sufficiently below the upper end of the gasifier to permit disengagement of the heavier char particles that might otherwise tend to be entrained with the gas leaving the bed.

As indicated above, the lower portion of the fluidized bed in the particular gasifier shown serves as a steam gasification zone. In the area between the grid or similar distribution device and the level at which the coal or the solids feed material is introduced, the injected steam reacts with carbon in the hot char particles to form synthesis gas containing hydrogen and carbon monoxide. The hydrogen concentration in the gaseous phase of the fluidized bed increases from essentially zero at the bottom of the bed to a value of about 30 to 50 volume percent or more near the upper surface of the bed. The temperature in the steam gasification zone will generally range between about 1450° and about 1950° F. Depending upon the particular feed material and particle size employed, the gas velocity from the fluidized bed will generally range between about 0.2 and about 2.0 feet per second or more.

In the particular configuration described herein, the upper portion of the fluidized bed in gasifier 15 serves as a hydrogasification zone where the feed coal is devolatilized and at least part of the volatile matter which is liberated reacts with hydrogen generated in the steam gasification zone below to produce methane. Other reactions, including the reaction of hydrogen with carbon to form methane, also take place. As indicated earlier, the level at which the solids feed stream is introduced and hence the location of the steam gasification and hydrogasification zones depends in part on the properties of the particular coal or carbonaceous feed material which is employed in the process. It is generally preferred to select the injection level so that the methane yield from the gasifier will be maximized and the tar yields minimized. The amount of methane produced generally increases as the coal feed injection point is moved upwardly towards the top of the fluidized bed, other operating conditions being the same. In this particular system, the solids feedstream should generally be introduced into the gasifier at a point where the hydrogen concentration in the gas phase is in excess of about 20 percent by volume, preferably between about 30 and about 50 volume percent.

In general, it is preferred that the upper level of the fluidized bed in gasifier 15 be maintained sufficiently above the feed injection level to provide at least 4 seconds of residence time for the gas phase in contact with the fluidized solids in the hydrogasification zone. A residence time of between 10 and about 20 seconds is normally advantageous. The optimum hydrogen concentration at the feed injection level and the gas residence time above that level will vary with various types and grades of coal or other feed solids and will also change with variations in the gasification temperature, pressure, steam rate and other process variables. Higher rank bituminous coals normally require somewhat more severe reaction conditions and longer residence times to obtain high methane yields and low tar yields than coals of lower rank. Similarly, higher reaction temperatures generally tend to increase the hydrogen concentration in the gas phase and reduce the gas residence times needed to secure acceptable methane and tar yields from a particular feed material.

The raw product gas from the fluidized bed in gasifier 15 moves upwardly from the upper surface of the bed, carrying entrained solids with it. This gas is withdrawn from the gasifier through overhead line 21 and passes to a primary cyclone separator or similar device 22 where the larger entrained solids are separated from the gas. In lieu of an external separator as shown in the drawing, the gasifier may contain one or more internal cyclones or similar devices for the removal of entrained solids from the upflowing gas stream. The solids removed from the gas in separator 22 are conveyed downwardly through dip legs 23 and 24 for reinjection into the system as described hereafter. The overhead gas from the separation unit 22 is passed through line 25 to a secondary cyclone or equivalent separation unit 26 where additional entrained solids are removed from the gas. The fines thus recovered are withdrawn by means of dip leg 27 and may be passed with the solids from the first separation unit through dip leg 24 for injection into a transfer line burner as shown in the drawing or for reinjection into the gasifier. The raw product gas taken overhead from unit 26 through line 28 may be passed through heat transfer unit 29 for the recovery of sensible heat in the gas by indirect heat transfer with water or other cooling fluid introduced through line 31 and withdrawn through line 32. Although only a single heat transfer unit is depicted, it will be understood that a battery of heat exchangers or similar devices may be employed for the recovery of heat from the gas stream if desired.

The heat required for the gasification process shown in the drawing is generated by continuously withdrawing char particles from the fluidized bed in the lower portion of the gasifier by means of line 33, passing these particles and fines from dip leg 24 into an upflowing stream of carrier gas introduced into the system through line 34, and injecting this stream containing entrained solids into the lower end of transfer line burner 35. The carrier gas employed may be recycled flue gas, inert gas or the like. An oxygen-containing gas, normally air, is injected into the system through line 36 and introduced into the lower end of the burner through manifold 37 and peripherally spaced injection lines 38. It is generally preferred to dilute the oxygen-containing gas introduced at the bottom of the burner with recycle flue gas or inert gas introduced through line 39 so that the oxygen content of the gas entering the burner at this point is about 15 percent or less, preferably less than about 6 percent. Additional oxygen-containing gas, normally air, is introduced into the upper portion of the burner through line 40, manifolds 41 and 42, and peripherally spaced injection lines 43 and 44. The combustion of carbon as the solids move upwardly through the burner in the presence of the oxygen-containing gas results in heating of the solid particles to a temperature in excess of that within gasifier 15.

It is generally preferred to control the operation of the transfer line burner 35 so that the solid particles leaving the upper end of the burner have a temperature of about 50° to about 300° F. above the fluidized bed temperature in gasifier 15. Solids leaving the burner enter cyclone separator or similar device 45 where the larger particles are removed from the gas stream and conveyed downwardly through line 46 for reintroduction into the gasifier with the carrier gas introduced through line 18. This circulation of hot solids between the gasifier and the transfer line burner maintains the fluidized bed in the gasifier at the required operating temperature and supplies the heat necessary for the endothermic reactions taking place within the gasifier. The buildup of ash within the fluidized bed in the gasifier can be avoided by the periodic or continual withdrawal of solids from the gasifier through line 47. These solids may be conveyed to a fluidized bed vessel not shown in the drawing for cooling and then transferred to a second vessel which is not shown for their removal from the system as a slurry in water. The solids withdrawal rate can be controlled by controlling the pressure within the fluidized bed vessel or by other means.

The raw flue gases from cyclone separator 45 are taken overhead through line 48 and passed to a primary burner cyclone separator or similar device 49 where entrained fine solids are removed and conveyed downwardly through dip legs 50 and 51. These fine particles may be introduced into a stream of carrier gas such as that in line 34 and reintroduced into the burner with the solid particles from line 33 for combustion in the burner. The raw gas taken overhead from separation unit 49 through line 52 is passed through a secondary burner cyclone or similar device 53 where additional fines are removed. These fines may be discharged downwardly through line 54 and combined with the solids in dip leg 51 for reintroduction into the burner. The overhead gases from separator 53 are passed through line 55 to heat transfer unit 56 where sensible heat is removed by indirect heat exchange with water or other fluid introduced through line 57 and withdrawn through line 58. Again, a battery of heat exchangers or the like may be employed in lieu of the single unit shown in the drawing if desired.

The composition of the raw product gas withdrawn from heat transfer unit 29 in the process described above will depend in part upon the composition of the feed coal or other carbonaceous solids employed in the process and the operating conditions used. Analyses for two typical feed coals that may be employed in such a process are shown in the following table:

TABLE I

| | Coal Compositions Illinois No. 6 Coal | Wyodak Coal |
|---|---|---|
| Ultimate Analysis Wt. % Dry Basis | | |
| Carbon | 69.8 | 68.5 |
| Hydrogen | 5.1 | 4.8 |
| Oxygen | 10.0 | 17.1 |
| Nitrogen | 1.1 | 0.9 |
| Sulfur | 4.4 | 0.5 |
| Ash | 9.6 | 8.2 |
| Total | 100.0 | 100.0 |
| Moisture Content, Wt. % (As received) | 16.0 | 31 |
| Higher Heating Value Btu/lb. (As received) | 10,602 | 8,157 |
| Higher Heating Value Btu/lb. (Dry) | 12,621 | 11,822 |
| Ash Analysis, Wt. % Oxides, Dry Ash (Based on fines from cyclones) | | |
| $P_2O_5$ | 0.2 | 1.06 |
| $SiO_2$ | 46.5 | 24.2 |
| $Fe_2O_3$ | 21.8 | 4.3 |
| $Al_2O_3$ | 21.1 | 15.6 |
| $TiO_2$ | 1.5 | 1.5 |
| CaO | 2.4 | 33.1 |
| MgO | 1.2 | 7.3 |
| $SO_3$ | 0.73 | 10.4 |
| $Na_2O$ | 0.2 | 0.4 |
| $K_2O$ | 2.0 | 0.1 |
| Total | 97.63 | 97.96 |

The above coals contain, in addition to the constituents listed in the above table, trace elements such as cadmium, cobalt, lead, zinc, mercury, antimony, arsenic and the like which are toxic in low concentrations and could present a health hazard if discharged in the gaseous or aqueous effluents from the process. The concentrations in which these trace elements are present vary from one coal to another, but they are found to some extent in virtually all coals and similar carbonaceous solids used for the production of synthesis gas and the like. Because the concentrations are quite low, they are difficult to analyse for. The concentrations in which they may be present are illustrated by the results of the analysis of 16 West Virginia coals as published by W. J. W. Hedlee and R. G. Hunter in *Industrial and Engineering Chemistry*, Vol. 45, pages 548–51 (1953). These results are summarized in Table II:

TABLE II

| Average Ash Composition of W. Va. Coals Constituent | Wt. % | Constituent | Wt. % |
|---|---|---|---|
| $Li_2O$ | 0.075 | CoO | 0.010 |
| $Na_2O$ | 1.78 | $Cr_2O_3$ | 0.023 |
| $K_2O$ | 1.60 | cuO | 0.061 |
| $Rb_2O$ | 0.030 | GaO | 0.022 |
| CaO | 2.76 | $GeO_2$ | 0.011 |
| SrO | 0.38 | HgO | 0.011 |
| BaO | 0.22 | $La_2O_3$ | 0.030 |
| MgO | 0.98 | MnO | 0.046 |
| $Al_2O_3$ | 29.9 | $MoO_3$ | 0.016 |
| $SiO_2$ | 43.9 | NiO | 0.047 |
| $Fe_2O_3$ | 15.9 | $P_2O_5$ | 0.35 |
| $TiO_2$ | 1.52 | PbO | 0.048 |
| $Ag_2O$ | 0.0010 | $Sb_2O_3$ | <0.005 |
| $As_2O_3$ | <0.07 | $SnO_2$ | 0.020 |
| $B_2O_3$ | 0.12 | $V_2O_5$ | 0.050 |
| BeO | 0.008 | $WO_3$ | <0.01 |
| $Bi_2O_3$ | <0.004 | ZnO | 0.053 |
| $Cb_2O_5$ | 0.010 | $ZrO_2$ | 0.029 |

The values in Table I and Table II above illustrate the quantities in which the toxic trace element constituents may be present in coals and similar carbonaceous solids useful as feedstocks for coal gasification and related processes. Although the amounts of these materials in the feed vary for different coals and are quite small, the total quantities handled in a large plant processing several thousand tons of coal per hour will be substantial and may constitute a serious hazard unless steps are taken to effect the removal of such materials from the effluent streams. Typical compositions for the raw product gas and flue gas from a process of the type depicted in the drawing, for the two feed coals set forth in Table I above, are shown in Table III below.

TABLE III

| Product Gas and Flue Gas Compositions, Mol % Constituent | Illinois No. 6 Coal Product Gas | Illinois No. 6 Coal Flue Gas | Wyodak Coal Product Gas | Wyodak Coal Flue Gas |
|---|---|---|---|---|
| CO | 18.8 | 9.1 | 20.5 | 8.8 |
| $CO_2$ | 8.7 | 13.0 | 10.0 | 13.3 |
| $H_2$ | 33.9 | 1.9 | 35.5 | 2.2 |
| $H_2O$ | 24.1 | 9.5 | 22.9 | 10.3 |
| $CH_4$ | 10.4 | — | 8.8 | — |
| $C_2H_6$ | 0.7 | — | 0.7 | — |
| $C_3H_8$ | — | — | — | — |
| $N_2$ | 1.1 | 65.2 | 0.9 | 64.5 |
| $H_2S$ | 1.3 | — | 0.1 | — |
| $SO_2$ | — | — | — | — |
| COS | — | — | — | — |
| $C_6H_6$ | 0.6 | — | 0.3 | — |
| Oils | 0.2 | — | 0.1 | — |
| $O_2$ | — | — | — | — |
| A | — | 0.8 | — | 0.8 |
| Total | 99.8 | 99.5 | 99.8 | 99.9 |

The values in the above table cover only the major constituents of the gas stream and do not include volatile trace element constituents which are present in the gas and will be transferred to the aqueous effluents upon scrubbing of the gas streams. Neither are the fine solids which bypass the cyclones and are transferred to the scrubber water shown. It will be noted that the hydrogen sulfide content of the product gas produced with Illinois No. 6 coal is substantially higher than that of the gas made with Wyodak coal. This difference in $H_2S$ content reflects the difference in the sulfur contents of the feed coals. Ammonia, hydrogen cyanide, phenols and other contaminants also present in the gas streams in small concentrations are not shown in the above table.

The raw product gas, which emerges from the gasifier at a temperature between about 1300° and about 1900° F., depending upon the gasifier operating conditions, is cooled to a temperature between about 450° and about 1000° F. in heat transfer unit 29 and then passed through line 60 to a scrubber 61, preferably a venturi scrubber where the hot gas is contacted with water introduced through lines 62 and 63. Here the water is entrained in the gas and the resulting fluid is passed through line 64 to separation vessel 65 from which the gas, now generally at a temperature between about 200° and about 450° F., is taken off overhead through line 66 for downstream processing. Such processing may include contacting of the gas with an alkali metal compound or similar shift conversion catalyst to adjust the hydrogen to carbon monoxide ratio, treatment of the gas stream with a solvent such as monoethanolamine, diethanolamine, hot potassium carbonate, methanol or the like for the removal of acid gas constituents, contact with an absorbent for the recovery of light hydrocarbon liquids remaining in the gas stream, and treatment with zinc oxide or a similar material for the removal of trace quantities of hydrogen sulfide remaining in the gas stream. Thereafter, the gas can be methanated by conventional means to increase the methane content, compressed and dried, and sent to storage for use as a synthetic natural gas. Alternatively, the methanantion step may be omitted and the product gas employed as a low Btu fuel gas or feed stock to a Fischer-Tropsch plant. Other conventional downstream processing such as cryogenic treatment for the recovery of methane, hydrogen and other constituents may also be employed if desired.

The scrubber water from separation vessel 65 is withdrawn through line 67. This aqueous stream will normally contain trace element constituents removed from the gas, include sulfur and nitrogen compounds absorbed by the water, and have an alkaline pH in the range between about 7.5 and about 9.5. Typical analyses for scrubber water recovered from the countercurrent scrubbing of particulates-free gases produced by gasification of the coals set forth in Table I above with water in a packed column are reported in Table IV below.

TABLE IV

| Component | Product Gas Scrubber Water Analyses: Illinois No. 6 Product Gas Water Run A | Run B | Run C | Wyodak Product Gas Water Run A | Run B |
|---|---|---|---|---|---|
| Sulfur | | | | | |
| Sulfide, ppm | 2043 | 1812 | 1092 | 259 | 187 |
| Mercaptan, ppm | 245 | — | — | <7 | <4 |
| Thiosulfate, ppm | 124 | — | — | 22 | <22 |
| Sulfite, ppm | 13 | — | — | | 13 |
| Sulfate, ppm | 79 | — | — | <5 | <5 |
| Thiocyanate, ppm | 60 | — | 9 | 0.8 | 1 |
| Polysulfide, ppm | — | — | — | 0.4 | <0.1 |
| Total S (X-Ray) | — | <22 | <22 | — | — |
| Nitrogen | | | | | |
| Free $CN^-$, ppm | 49 | 13 | 66 | 41 | 22 |
| Thiocyanate, ppm | 109 | 18 | 16 | 1 | 2 |
| Ammonia, Wt. % | — | 0.78 | 0.68 | 1.62 | 3.04 |
| $CO_2$, Wt. % | — | 1.12 | 1.14 | 4.40 | 7.64 |
| Total Solids, Wt. % | — | 0.062 | 0.039 | 0.0025 | 0.0037 |
| Phenol, ppm | — | 2.4 | 7.4 | <1 | 1 |
| pH | — | 8.40 | 8.30 | 8.7 | 8.9 |

It will be noted from the above table that the sour water produced by scrubbing the product gas has a relatively high sulfide content. That for the water used to scrub the gas produced with Illinois No. 6 coal was significantly higher than that for the water used to scrub gas from the Wyodak coal because of the higher sulfur content of the Illinois coal and the resulting high hydrogen sulfide content of the product gas. The variations in the values reported, in addition to reflecting differences in the sulfur content of the feed coal and the hydrogen sulfide content of the product gas, may also be in part attributable to variations in the quantity of water used per volume of product gas. In general, however, it has been found that the scrubber water obtained by scrubbing the product gas stream will contain about 200 to about 2500 parts per million of hydrogen sulfide and will have an alkaline pH buffered by ammonium bicarbonate and ammonium carbonate in the water as a result of the absorption of ammonia and carbon dioxide from the gas.

The flue gas from the transfer line burner cyclones is treated in a manner similar to that described above. The hot gas from the burner, at a temperature between about 1500° and about 2000° F. is cooled in heat transfer unit 56 to a temperature on the order of from about 450° to about 750° F. and then injected through line 70 into a venturi scrubber or other scrubbing device 71. Here water injected through lines 62 and 72 is entrained in the gas and the resultant stream is introduced through line 73 into separator 74. The overhead gas from the separator, withdrawn through line 75, may be reheated, expanded to a turbine, and then further processed for the removal of gaseous contaminants before it is discharged into the atmosphere or used as a fuel in a carbon monoxide boiler to supply additional heat for the process.

The scrubber water recovered from the flue gas scrubber separation vessel 74 is withdrawn through line 76. This aqueous stream will contain trace element constituents removed from the gas, will contain sulfur and ammonium compounds in somewhat lower concentrations than the product gas scrubber water, and will usually have an acid pH. Typical analyses for flue gas scrubber water streams obtained by the countercurrent scrubbing of particulates-free flue gas with water in a packed column are shown in Table V below.

TABLE V

| Component | Flue Gas Scrubber Water Analyses: Illinois No. 6 Flue Gas Water Run B | Run C | Wyodak Flue Gas Water Run A | Run B |
|---|---|---|---|---|
| Sulfur | | | | |
| Sulfide, ppm | 2 | <2 | <1 | <1 |
| Mercaptan, ppm | | | <1 | <1 |
| Thiosulfite, ppm | 33 | 183 | <12 | <11 |
| Sulfite, ppm | — | 54 | <5 | <5 |
| Sulfate, ppm | 200 | 154 | <5 | <5 |
| Thiocyanate, ppm | — | <1 | <0.5 | <0.1 |
| Polysulfide, ppm | — | — | <0.1 | <0.1 |
| Total S (X-Ray) | 383 | 522 | — | — |
| Nitrogen | | | | |
| Free $CN^-$, ppm | <1 | <1 | <0.5 | <0.1 |
| Thiocyanate, ppm | <1 | <1 | <1 | <0.1 |
| Ammonia, Wt. % | 0.017 | 0.020 | 0.02 | 0.003 |
| $CO_2$, Wt. % | 0.024 | 0.017 | 0.03 | 0.23 |
| Total Solids, Wt. % | 0.087 | — | 0.0015 | 0.0016 |
| Phenol, ppm | 0.6 | — | <1 | <1 |
| pH | 5.40 | 2.90 | 5.2 | 5.2 |

Again it will be noted that the sulfur and nitrogen content of the water obtained by scrubbing the flue gas from Wyodak coal was somewhat lower than used in scrubbing the gas from Illinois No. 6 coal because of the lower sulfur and nitrogen content of the Wyodak coal. It can also be seen that the hydrogen ion content of the flue gas scrubber water was substantially higher than that of the product gas scrubber water. In some cases, however it may be lower.

The two scrubber water streams produced as described above are combined in line 77 and fed into steam stripper or similar device 78. As indicated in Tables IV and V above, the water from the product gas scrubber will ordinarily be alkaline and that from the flue gas scrubber will generally be acidic. The pH values may vary, however, depending upon the coal or other feed solids used and the operating conditions employed. The combined streams fed to the stripper should generally have a pH of about 7 or higher and hence caustic, ammonium hydroxide or a similar alkaline reagent may be added to the water, through line 79 for example, in quantities sufficient to attain the desired pH if pH adjustment is required. On combining of the two scrubber water streams and adjustment of the pH if necessary, trace element compounds present in the water react with hydrogen sulfide in the system to precipitate the corresponding trace element sulfides. As shown in Table VI below, these sulfides have very low solubility product values as evidenced by their occurrence in nature as minerals.

TABLE VI

Solubility Products of Toxic Element Sulfides (18° C.)

| Compound | Ksp (moles²/Liter²) | Mineral Name |
|---|---|---|
| CdS | $3.6 \times 10^{-29}$ | Greenockite |
| CoS | $3.0 \times 10^{-26}$ | Sycoporite |
| CuS | $8.5 \times 10^{-45}$ | Covellite |
| $Cu_2S$ | $2.0 \times 10^{-47}$ | Chalcocite |
| FeS | $3.7 \times 10^{-19}$ | Troilite |
| PbS | $3.4 \times 10^{-28}$ | Galena |
| MnS | $1.4 \times 10^{-15}$ | Alabandite |
| HgS | $4 \times 10^{-53}$ to $2 \times 10^{-49}$ | Cinnabar |
| Nis | $1.4 \times 10^{-24}$ | Millerite |
| ZnS | $1.2 \times 10^{-23}$ | Wurtzite; Sphalerite |
| $As_2S_3$ | $4.4 \times 10^{-27}$* | Orpiment |
| $Sb_2S_3$ | $3.0 \times 10^{-25}$* | Stibnite |

*Calculated from solubility data.

The behavior of toxic trace elements present in the spent scrubber water is a function of the solubility product for the trace element compounds and the hydrogen sulfide dissociation equilibria in the combined aqueous stream. The solubility product is defined as the product of cation and anion concentrations in moles per liter: $Ksp = (M^+)(X^-)$. If the product of the cation and anion concentrations in the system under consideration is less than the solubility product value, the compound containing the cation and anion will be soluble in the water to form an unsaturated solution. If the product of the cation and anion concentrations is equal to the solubility product, the compound containing the cation and anion will be soluble in the water to form a saturated solution. Where the product of the cation and anion concentrations is greater than the solubility product value, the compound will precipitate until the product of the cation and anion concentrations is equal to the solubility product.

The hydrogen sulfide equilibria for dissociation in the combined scrub water stream is governed by the following expressions:

$$H_2S \rightleftarrows H^+ + HS^- \quad K_I = 1.1 \times 10^{-7}$$
$$HS^- \rightleftarrows H^+ + S^= \quad K_{II} = 1.0 \times 10^{-14}$$

From the above, the hydrogen sulfide dissociation is defined as follows:

$$\frac{(H^+)^2 (S^=)}{(H_2S)} = 1.1 \times 10^{-21},$$

where the concentrations are expressed in moles per liter.

This expression is pH dependent and if either the sulfide or hydrogen sulfide concentration in the system is known at a given pH, the value of the other is fixed.

Scrubber water analyses for the combined product gas and flue gas scrubber water streams produced during the gasification of Illinois No. 6 and Wyodak coals have shown average hydrogen sulfide concentrations of about 2500 and 300 ppm respectively. These are equivalent, respectively, to $7.35 \times 10^{-2}$ and $8.82 \times 10^{-3}$ moles of hydrogen sulfide per liter. The hydrogen sulfide dissociation values are therefore $8.1 \times 10^{-23}$ for the Illinois No. 6 coal scrubber water and $9.7 \times 10^{-24}$ for the Wyodak coal scrubber water. Using values such as these for various scrubber water pH levels and knowing the solubility product values for the metal sulfides, the maximum trace metal solubility in the water at various pH values can be readily calculated. The maximum soluble lead (II) ion concentration, for example, is given by the expression $$(Pb^{++}) = \frac{Ksp}{(S^=)} = \frac{3.4 \times 10^{-28}}{(S^=)}.$$

The sulfide ion concentration in the above equation depends upon the particular coal employed and the pH of the water and the concentration of soluble metal is given in moles per liter, which can be converted into grams per liter and then into parts per million or parts per trillion. Calculated values for such trace element metals in the combined aqueous stream from the gasification of the two above-mentioned coals at various pH levels are shown in the following table.

TABLE VII

Calculated Maximum Solubilities of Selected Trace Elements in Combined Product Gas Scrubber-Flue Gas Scrubber Streams

| Compound | Coal | pH 8 | 7 | 5 | 4 | 1 |
|---|---|---|---|---|---|---|
| FeS | Wyodak | 0.2 pptr. | — | 0.21 ppm | 21.3 ppm | Soluble |
| | Ill. No. 6 | 0.026 pptr. | — | 0.025 ppm | 2.55 ppm | Soluble |
| PbS | Wyodak | $7 \times 10^{-12}$ pptr. | $7 \times 10^{-8}$ pptr. | — | — | 7.26 ppm |
| | Ill. No. 6 | $8.7 \times 10^{-12}$ pptr. | — | — | — | 0.87 ppm |
| CdS | Wyodak | $4 \times 10^{-11}$ pptr. | — | — | — | 0.42 ppm |
| | Ill. No. 6 | $5 \times 10^{-12}$ pptr. | — | — | — | 0.5 ppm |
| HgS | Wyodak | $4 \times 10^{-31}$ pptr. | — | — | — | $4 \times 10^{-15}$ pptr. |
| | Ill. No. 6 | — | — | — | — | $5 \times 10^{-15}$ pptr. |

It can be seen from the above table that the trace element sulfides are essentially insoluble in the combined aqueous scrubber stream at pH values of about 6 or higher and that the trace elements will therefore be precipitated upon mixing of the scrubber water streams. This provides a highly effectivve and convenient means for eliminating the trace elements from aqueous effluents from the process and makes possible the discharge of such effluents following precipitation and removal of the solids without any significant danger of polluting the environment with soluble trace element compounds.

The combined stripper water fed to the stripper 78 as described above is contacted in the stripper with steam or other stripping gas introduced into the system through line 80. The stripping gas removal hydrogen sulfide, carbon dioxide, hydrogen cyanide, ammonia and other dissolved gases from the aqueous stream and carries them overhead through line 81, from which the gas may be passed to a gas incineration unit or other downstream facilities designed to permit eventual disposal of the noxious constituents without atmospheric pollution. The stripping action taking place within vessel 78 will, of course, tend to reduce the hydrogen sulfide content of the water within the vessel and promote a change in pH. To compensate for this in cases where the amount of dissolved hydrogen sulfide introduced with the water through line 77 is relatively low, additional hydrogen sulfide may be introduced into at least one of the scrubber water streams if desired, through line 82 for example in quantities sufficient to effect essentially complete precipitation of the trace elements present in the water. Water containing precipitated sulfides, as well as any other solids that may have been carried over with the aqueous scrubber effluent, is withdrawn from stripper 78 through line 83 and passed to a rotary filter or similar device 84 where the solids are removed. Wash water may be supplied to the filter as indicated by line 85 and the solids may be disposed of as indicated by line 86 by land fill or other means. The stability and insolubility of the sulfides permits their use in land fill operations with essentially no danger of pollution. The water from which the solids have been removed is withdrawn from the filter through line 87 and may be sent to a water treating plant for the elimination of other undersirable constituents before it is recycled in the system.

It should be apparent from the foregoing that the process of the invention provides a simple and economical system for the elimination of trace element constituents from aqueous effluents produced during processes such as the gasification of coal and similar carbonaceous solids which if not eliminated could accumulate and present serious pollution difficulties. The nature and objects of the invention are further illustrated by the following examples.

EXAMPLE 1

One hundred milliliters of a flue gas scrubber water produced by scrubbing the flue gas from the transfer line burner during the gasification of Illinois No. 6 coal in a coal gasification pilot plant including a fluidized bed gasifier and a transfer line burner generally similar to those shown in the drawing was combined with one hundred milliliters of the product gas scrubber water produced by scrubbing the product gas stream generated during the gasification operation. Analysis of samples of the individual scrubber water streams by atomic absorption showed that the flue gas scrubber water contained 245 parts per million of iron and that the product gas scrubber water had an iron content of 1.35 parts per million. The flue gas scrubber water and the product gas stripper water had hydrogen sulfide contents and pH values similar to those shown in Tables IV and V. A black precipitate formed almost immediately after the two 100 milliliter samples were combined. The precipitate was allowed to settle and a sample of the supernatant liquid was recovered for analysis. Thereafter, the precipitate was separated from the liquid by centrifugation, dried at moderate temperature in a vacuum oven, and then analyzed by emission spectrography. The analytical results showed that the supernatant liquid recovered following formation of the precipitate contained only one part per million of iron. The dried precipitate, on the other hand, contained major quantities of iron, minor amounts of zinc, and trace quantities of silicon, manganese, magnesium, nickel, chromium and copper. Boron, lead, molybdenum, vanadium, tin, titanium, zirconium, calcium and aluminum were also present. It should be noted that the scrubber water streams from which the samples tested were taken did not contain any fines, these having been separated from the gas streams by cyclones and gas filters upstream of the scrubbers.

The above results demonstrate that combining of the flue gas stripper water and the product gas stripper water from a gasification operation of the general type shown in the drawing results in the removal of metallic contaminants present in the aqueous effluents as insoluble sulfides. The reduction in the iron content from 245 parts per million in the flue gas stripper water and 1.35 parts per million in the product gas stripper water to one part per million in the combined water following precipitation of the metal sulfides illustrates the substantial reductions in metals which can be obtained. Although metals other than iron were not determined quantitatively because of the difficult lengthy analytical procedures that would have been required, the presence of numerous other metallic constituents in the precipitate shows that a wide variety of potentially hazardous contaminants can be removed from the aqueous effluents in this manner.

EXAMPLE 2

Samples of product gas scrubber water obtained by the scrubbing of product gas generated during the gasification of Illinois No. 6 coal in the pilot plant referred to in Example 1, flue gas scrubber water obtained by the scrubbing of flue gas from the transfer line burner during the gasification operation, and a mixture of equal parts of the product gas scrubber water and flue gas scrubber from which precipitated metal sulfides had been removed by centrifugation ware spectrographically analyzed for trace elements. The analyses were carried out by evaporating the samples on a steam bath in platinum dishes until approximately 10 milliliters of each original sample of 100 milliliters remained, adding 5 milliliters of magnesium nitrate solution to each sample to give a 0.05% ash for a 1-gram sample, and evaporating the samples to dryness. Glycerol and concentrated sulfuric acid were then added to each sample, the samples were carefully heated on a hot plate, and they were then placed in a muffle furnace at 1000° F. The platinum dishes containing the ashed samples removed from the furnace were then weighed to determine the total ash contents. After removal of the samples from the dishes, they were reweighed, blended with graphite containing 0.01 weight percent germanium oxide in a ratio of one part sample to 10 parts of the graphite, and thoroughly mixed. The ash samples and appropriate standard were packed in graphite electrodes and fired in duplicate using a direct current arc. The spectra of the samples were then compared to the standards. The limits of this technique are between 25 and 50 parts per billion. Some of the elements tested for could not be detected. The results obtained for cadmium, lead, molybdenum and cobalt are set forth in the following table.

TABLE VIII

Elemental Water Sample Analyses

| Sample | Element, Parts Per Billion* Cd | Pb | Mo | Co |
|---|---|---|---|---|
| Flue Gas Scrubber Water | <25 | ~200 | ~100 | ~100 |
| Product Gas Scrubber Water | N.D.** | ~10 | N.D. | N.D. |
| Combined Scrubber Water | N.D. | ~25 | ~25 | ~50 |

*Limit of technique is between 25 and 50 ppb.
**Not detected.

The above data further illustrate the process of the invention and illustrate its advantages. Although the data are not rigorously quantitative, they show that trace elements present in the scrubber water effluents in very low concentrations can be effectively removed from the effluent by the process of the invention.

EXAMPLE 3

In order to further demonstrate the advantages of the invention, a synthetic scrubber water was prepared by saturating distilled water with hydrogen sulfide and then adjusting the pH to about 9 by adding ammonium hydroxide. The sulfide concentration was determined to be $8.23 \times 10^{-2}$ moles per liter. Exactly 50.00 milliliter portions of this solution were combined with 25.00 milliliter portions of a $1.92 \times 10^{-2}$ molar sodium cyanide solution. To three of these mixtures were added exactly 25.00 milliliters of $4.48 \times 10^{-3}$ molar $Fe^{++}$ solution, $121 \times 10^{-3}$ molar $Pb^{++}$ solution, and $2.22 \times 10^{-3}$ molar $Cd^{++}$ solution, respectively. Each solution thus initially contained 1332 ppm of sulfide, 50 ppm of cyanide, and 250 ppm of one of the three metal ions and had a pH of between 8.7 and 9.0. Immediate precipitates formed in the case of the solution containing the iron and the lead ions. The solution containing the cadmium ions first turned yellow and then gave a precipitate. After the precipitates had settled, samples of the supernatant liquids were analyzed for metals and were found to contain 1.5 ppm of $Fe^{++}$, 0.22 ppm of $Pb^{++}$, and 1.5 ppm of $Cd^{++}$, respectively. These values again illustrate the very low levels to which trace metals concentrations can be reduced by the combining of scrubber water streams containing hydrogen sulfide in accordance with the invention.

As pointed out earlier, the process of the invention is not restricted to gasification processes of the type shown in the drawing and instead can be applied to other processes in which a first gas stream having a relatively high hydrogen sulfide content and a second gas stream which is low in hydrogen sulfide and contains potentially toxic trace elements are produced. Gasification processes in which the heat required for endothermic reactions taking place in the gasifier is supplied by injecting oxygen into the gasifier and steam for the gasification reaction is generated in an external coal or oil-fired boiler, for example, may produce such gas streams. By separately scrubbing the two streams with water, combining the scrubber water effluents, stripping out gases, and then filtering out solids from the combined scrubber water effluent, the concentrations of trace elements can be reduced to levels sufficiently low to alleviate substantially the health hazards and environmental problems that might otherwise be encountered. Still other operations in which the process is applicable will suggest themselves to those skilled in the art.

I claim:

1. In a process wherein a first gas stream containing hydrogen sulfide and a second gas stream having a lower hydrogen sulfide content than said first gas stream and including volatile trace element constituents are produced, the improvement which comprises scrubbing said first gas stream with water to produce a first scrubber water stream containing hydrogen sulfide removed from said first gas stream, scrubbing said second gas stream with water to produce a second scrubber water stream containing trace element constituents removed from said second gas stream, combining said first scrubber water stream and said second scrubber water stream to produce a combined scrubber water stream, stripping gases from said combined scrubber water stream to produce an aqueous stripper effluent, and thereafter removing precipitated solids from said aqueous stripper effluent.

2. A process as defined by claim 1 wherein said first gas stream is a raw product gas stream containing methane, hydrogen, carbon monoxide and carbon dioxide and said second gas stream is a raw flue gas stream.

3. A process as defined by claim 1 wherein said first scrubber water stream contains from about 200 to about 2500 ppm of hydrogen sulfide and has an alkaline pH value.

4. A process as defined by claim 1 wherein said second scrubber water stream has an acidic pH value.

5. A process as defined by claim 1 including the step of adjusting the pH value of said combined scrubber water stream to a value in excess of about 7.0 prior to the stripping of gases from said combined scrubber water stream.

6. A process as defined by claim 1 including the step of introducing gaseous hydrogen sulfide into at least one of said scrubber water streams following the scrubbing of said gas streams.

7. A process as defined by claim 1 wherein said first gas stream is a raw product gas stream produced by the gasification of a carbonaceous feed material and said second gas stream is a raw flue gas generated by the combustion of carbonaceous solids produced during said gasification of said carbonaceous feed material.

8. In a gasification process wherein a solid carbonaceous feed material is reacted with steam to produce a raw product gas containing methane, hydrogen, carbon monoxide, carbon dioxide, and hydrogen sulfide and wherein heat is generated by the combustion of carbonaceous solids to produce a raw flue gas having a lower hydrogen sulfide content than said raw product gas and including volatile toxic trace element constituents, the improvement which comprises scrubbing said raw product gas with water to produce a product gas scrubber water stream containing hydrogen sulfide removed from said product gas, scrubbing said raw flue gas with water to produce a flue gas scrubber water stream containing toxic trace element constituents removed from said flue gas, combining said product gas scrubber water stream and said flue gas scrubber water stream to produce a combined scrubber water stream, stripping gases from said combined scrubber water stream to produce an aqueous stripper effluent, and thereafter removing precipitated trace element sulfides from said aqueous stripper effluent.

9. A process as defined by claim 8 wherein said carbonaceous feed material comprises coal and said carbonaceous solids comprise coal char.

10. A process as defined by claim 8 wherein the pH of said combined scrubber water stream is adjusted to a value of about 7.0 or higher by the addition of an alkaline reagent prior to said stripping of said gases from said combined scrubber water stream.

* * * * *